US006002076A

United States Patent [19]

Karn

[11] Patent Number: 6,002,076

[45] Date of Patent: Dec. 14, 1999

[54] DOUBLE-MALLET HEEL-TOE DRUM PEDAL SYSTEM WITH HINGED MALLETS

[76] Inventor: Ryan W. Karn, 4544 Elm Dr., Newburgh, Ind. 47630

[21] Appl. No.: 09/210,080

[22] Filed: Dec. 11, 1998

[51] Int. Cl.[6] ..... G10D 13/02

[52] U.S. Cl. ..... 84/422.1; 84/422.4; 84/236

[58] Field of Search ..... 84/422.1, 422.2, 84/422.3, 422.4, 411 R, 236, 243

[56] References Cited

U.S. PATENT DOCUMENTS

| | | | |
|---|---|---|---|
| 357,093 | 2/1887 | Olney | 84/422.1 |
| 1,160,392 | 11/1915 | Domashewicz | 84/422 |
| 1,369,233 | 2/1921 | Fitzgerald et al. | 84/422.2 |
| 1,508,390 | 9/1924 | Gladstone et al. | 84/422 |
| 2,484,302 | 10/1949 | Laverents | 84/422 |
| 2,822,717 | 2/1958 | Slawienski | 84/422.1 |
| 2,845,830 | 8/1958 | Haviland | 84/422.1 |
| 2,893,284 | 7/1959 | Washington, Jr. | 84/422 |
| 3,618,441 | 11/1971 | Fearns | 84/422 |
| 3,677,128 | 7/1972 | Simpson | 84/422 |
| 3,967,523 | 7/1976 | Currier et al. | 84/422 |
| 3,988,957 | 11/1976 | Escamilla | 84/422 |
| 4,134,325 | 1/1979 | Loftus | 84/422 |
| 4,188,853 | 2/1980 | Bills | 84/422.1 |
| 4,945,803 | 8/1990 | Norwood | 84/422.1 |
| 5,421,234 | 6/1995 | Liao | 84/422.1 |
| 5,591,929 | 1/1997 | Wellman | 84/422.1 |
| 5,627,332 | 5/1997 | Lombardi | 84/422.1 |
| 5,767,428 | 6/1998 | Bloch | 84/422.1 |
| 5,877,441 | 3/1999 | Labute | 84/422.1 |

FOREIGN PATENT DOCUMENTS

| | | |
|---|---|---|
| 474469 | 4/1929 | Germany . |
| 3807213 | 7/1988 | Germany . |
| 2146162 | 4/1985 | United Kingdom . |
| 2172137 | 9/1986 | United Kingdom . |

*Primary Examiner*—Robert E. Nappi
*Assistant Examiner*—Wesley Ashton
*Attorney, Agent, or Firm*—Woodard, Emhardt, Naughton Moriarty & McNett

[57] ABSTRACT

A drum pedal system for independently actuating two drum beaters. In one embodiment, the pedal is split into a toe and a heel portion, each independently connected to a beater oriented adjacent a drum head. The drummer may independently actuate one or both beaters.

21 Claims, 10 Drawing Sheets

DOUBLE-MALLET HEEL-TOE DRUM PEDAL SYSTEM WITH HINGED MALLETS

TECHNICAL FIELD OF THE INVENTION

The present invention relates generally to the field of musical instrumentation and more specifically to a mechanical drum pedal assembly with dual mallets independently actuatable by a pedal.

BACKGROUND OF THE INVENTION

The modern drummer has been called upon to produce an increasingly challenging and complex selection of sounds in order to remain competitive in a field that not only includes other drummers but computer-driven electronic percussion synthesizers. In order to compete, the modern drummer must be able to play an array of several different percussion instruments virtually simultaneously. The drummer must also be able to supply a steady beat for an extended length of time without tiring.

The modern drummer frequently relies on both his hands and feet to play a variety of different drums and other percussion instruments. This allows the drummer to quickly switch back and forth from instrument to instrument. It is to the drummer's advantage to be able to spread his workload over as many limbs and muscle groups as possible to prolong his endurance and resist fatigue and injury. It is to his further advantage to be able to produce as many diverse combinations of sounds as possible. Instrumentation allowing the drummer to spread his workload over different muscle groups while also giving him additional musical options is valuable to the drummer.

One well-known device that allows a drummer to use his feet to play a drum (usually a bass) is the foot-pedal actuated drum beater. A number of different foot-pedal actuated drum-beaters have been devised, each offering some advantages to the drummer. These prior art devices include those described in the following: U.S. Pat. No. 1,508,390 issued to Gladstone et al. on Sep. 16, 1924; U.S. Pat. No. 2,484,302 issued to Laverents on Oct. 11, 1949; U.S. Pat. No. 3,618,441 issued to Fearns on Nov. 9, 1971; U.S. Pat. No. 3,677,128 issued to Simpson on Jul. 18, 1972; U.S. Pat. No. 3,988,957 issued to Escamilla on Nov. 2, 1976; U.S. Pat. No. 4,188,853 issued to Bills on Feb. 19, 1980; and U.S. Pat. No. 4,945,803 issued to Norwood on Aug. 7, 1990.

Gladstone discloses a single double-acting mallet actuated by the forward depression of a foot pedal. Laverents shows a pair of beaters that alternately strike a single drumhead, actuated by the heel-to-toe rocking motion of the drum pedal. Fearns relates a single double-acting beater that may be driven by the rocking motion of a foot pedal. Simpson discloses a pair of mallets, each striking its own drum, actuatable respectively by the toe and heel of a single split pedal. Escamilla shows a drum pedal assembly wherein a split foot pedal operates a pair of drumsticks against a single drum head. Bills relates a pair of drum beaters that alternately strike a single drum head, the beaters being activated by the forward depression of a single toe pedal. And Norwood similarly shows a pair of mallets that alternately strike a single drum head upon the forward depression of a single toe pedal.

While these devices have proven somewhat helpful, they suffer from some disadvantages. Some require two separate drums, which take up space that could be used for different percussion instruments. Others are limited in that the pair of mallets disclosed may only operate alternately and not independently of each other. Still others employ rough mechanical means that generate an unwelcome level of noise. And all of the above devices are limited to a single type of sound generated by beating a rigid drumstick or mallet against an unobstructed drum head.

Despite the above advances, there is still a need for a foot-pedal actuated drum beater system that gives the drummer a greater variety of musical options while optimizing instrument space and minimizing muscle fatigue on the part of the drummer.

Hence, there is a need for an improved foot pedal device for playing a drum. The present invention satisfies this need.

SUMMARY OF THE INVENTION

The present invention relates to a drum pedal system for independently actuating two articulated drum mallets. A single pedal may actuate either or both mallets. The mallets may be actuated simultaneously or sequentially, and may be locked in place, either away from or in contact with a drum face.

One form of the present invention contemplates an assembly, comprising: a base having a pedal axis shaft system having at least one pedal axis shaft and a raised mallet axis shaft; a pedal having a toe portion and a heel portion, the toe portion depressibly connected to the pedal axis shaft system and the heel portion depressibly connected to the pedal axis shaft system; a first set of disks rotatably mounted to the base; a second set of at least one disk rotatably mounted to the base; a first mallet pivotally coupled to the mallet axis shaft; a second mallet pivotally coupled to the mallet axis shaft; a first flexible linkage connected between the toe portion and the periphery of the first set of rotatably mounted disks, wherein depression of the toe portion around a pedal axis shaft causes rotation of the first mallet into contact with the drum head; and a second flexible linkage connected between the heel portion and the periphery of the second set of at least one rotatably mounted disk, wherein depression of the heel portion around a pedal axis shaft causes rotation of the second mallet into contact with the drum head.

One object of the present invention is to provide an improved foot-pedal actuated drum beating system. Related objects and advantages of the present invention will be apparent from the following description.

DETAILED DESCRIPTION OF THE PREFERRED EMBODIMENT

Figure 1A:
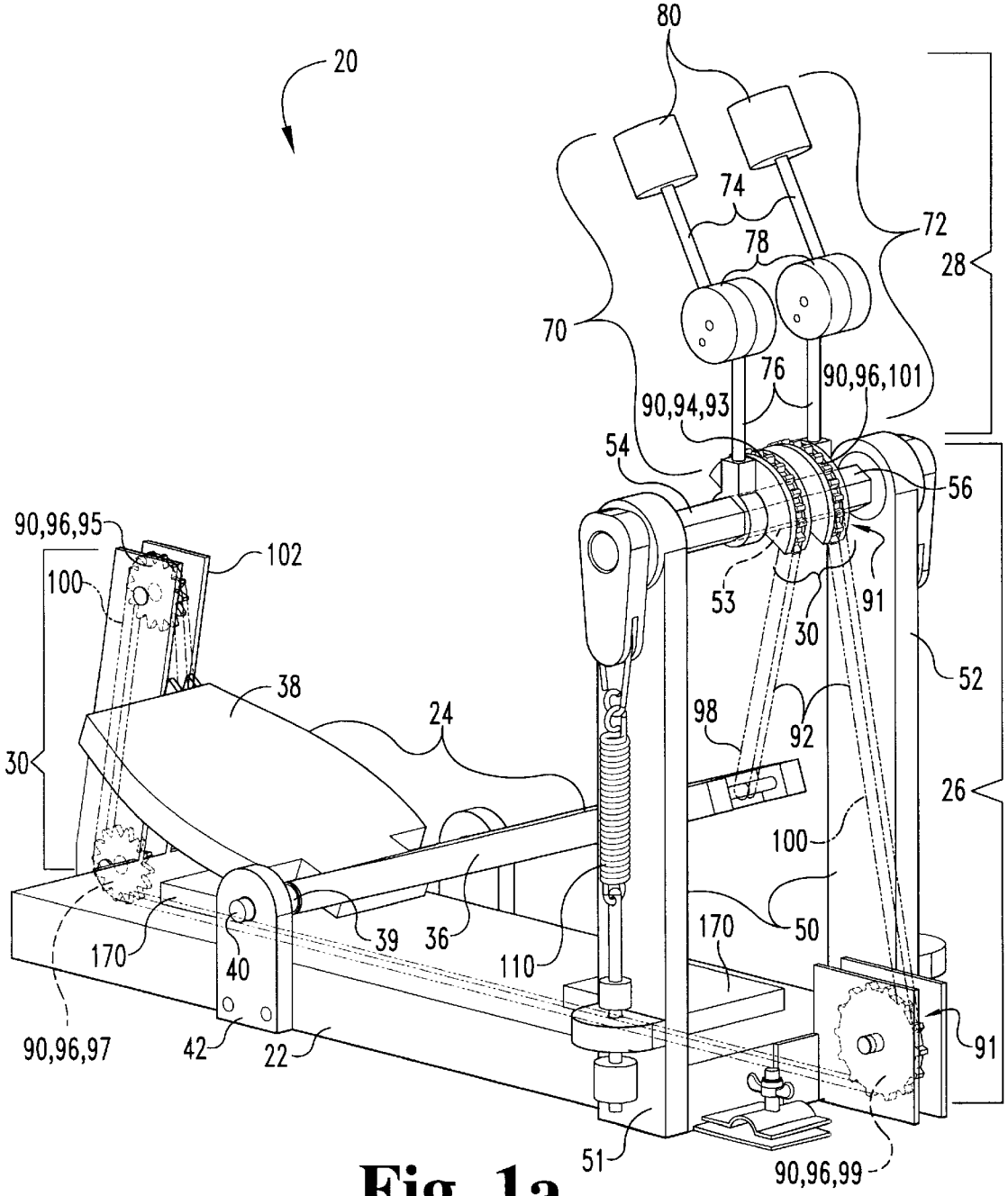
FIG. 1*a* is a perspective view of a first embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
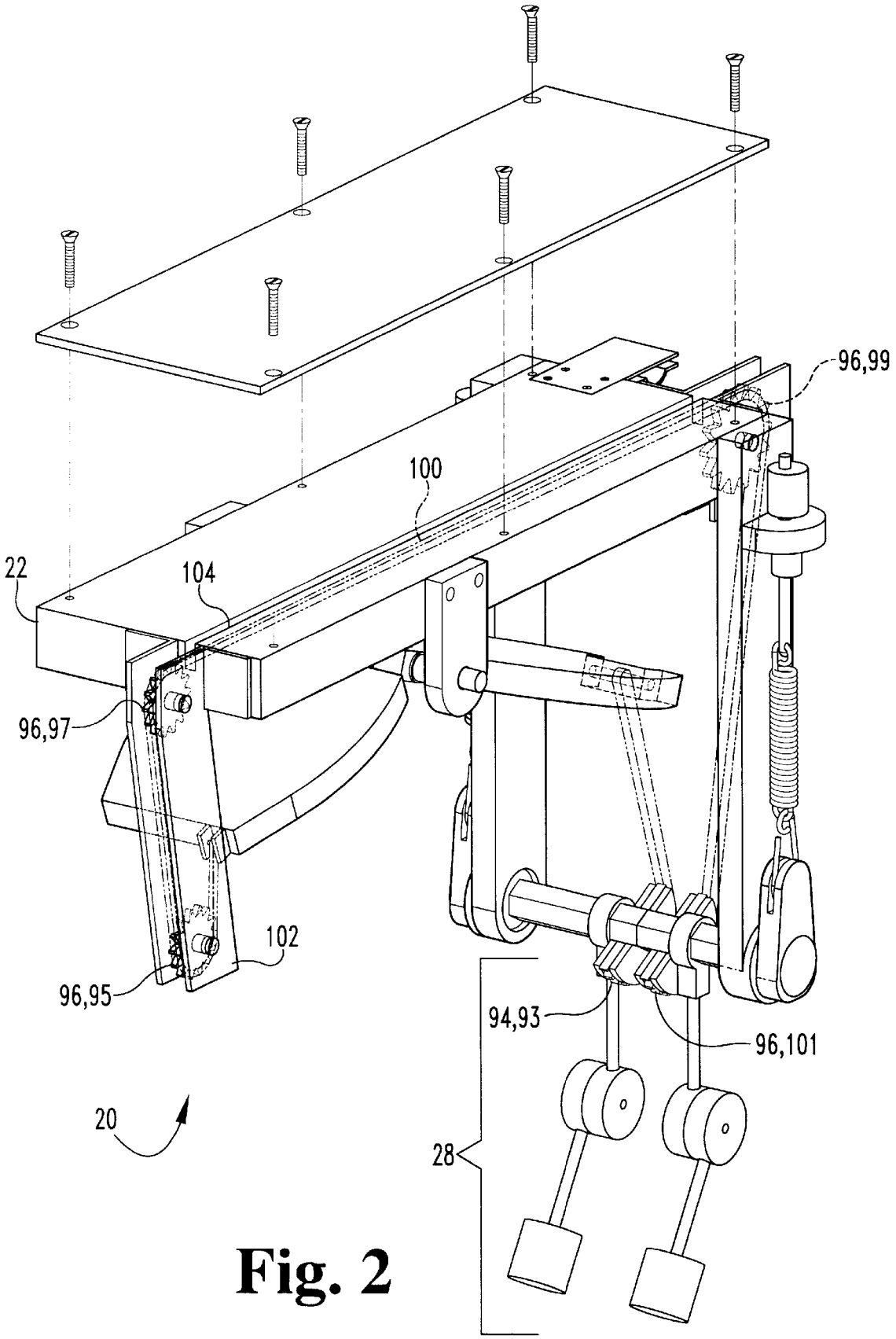
FIG. 2 is an exploded bottom perspective view of the embodiment of FIG. 1*a*.

Referring to FIG. 1*a*, there is illustrated a first embodiment the present invention, a pedal operated drum beater assembly 20. FIG. 1*a* shows a base 22, to which is connected a pedal 24, a mallet support assembly 26, a mallet assembly 28, and a linkage assembly 30. The base 22 is substantially flat, and is formed of structural material, such as sheet metal, steel, plastic, wood or the like. (See FIG. 2) The base 22 may be a solid piece or slab, or may be a framework.

The pedal 24 has substantially the same length as the base 22, and is made up of a toe portion 36 and a heel portion 38 depressibly joined together at the pedal axis rod 40. The pedal 24 has substantially the same outline as that of a human foot, although this is not essential to the invention. The toe portion 36 is typically longer than the heel portion 38. The toe portion 36 and the heel portion 38 are pivotally coupled to a pedal axis rod or shaft system 39 having at least one elevated pedal axis rod 40, such that the toe portion 36 and the heel portion 38 may rotate partially around the pedal axis rod 40. In the embodiment shown in FIG. 1*a*, the toe portion 36 and heel portion 38 are both coupled to a single pedal axis rod 40. Alternately, the toe portion 36 and the heel portion 38 may each be separately coupled to a different pedal axis rod 40, as seen in the embodiment shown in FIGS. 1*b* and 1*c*.

The independent coupling of the pedal portions 36, 38 allows a drummer to spread the drum operation from toe to heel, reducing fatigue and possible muscle and/or tendon damage. The drummer has the option of using the toe portion 36 only, the heel portion 38 only, or alternating back and forth between the two by using a rocking motion of his foot, in order to rest tired muscle groups while continuing to play. The drummer also has the option of using both toe and heel 36,38 portions together simultaneously or in quick succession to expand his rhythmic options through new and creative percussive techniques. The pedal axis rod 40 is supported by a pair of pedal axis rod supports 42 mounted on either side of the base 22. The pedal axis rod 40 traverses the width of the base 22 and is positioned with respect to the base 22 such that the pedal 24 substantially covers the base 22.

The mallet support assembly 26 consists of a pair of mallet support members 50 extending upwardly from either side of the base 22. The mallet support members 50 include a first mallet support member 51 and a second mallet support member 52, although other embodiments are contemplated having only one mallet support member 51. The mallet support members 50 are typically connected at or near the toe end of the base 22.

Figure 3:
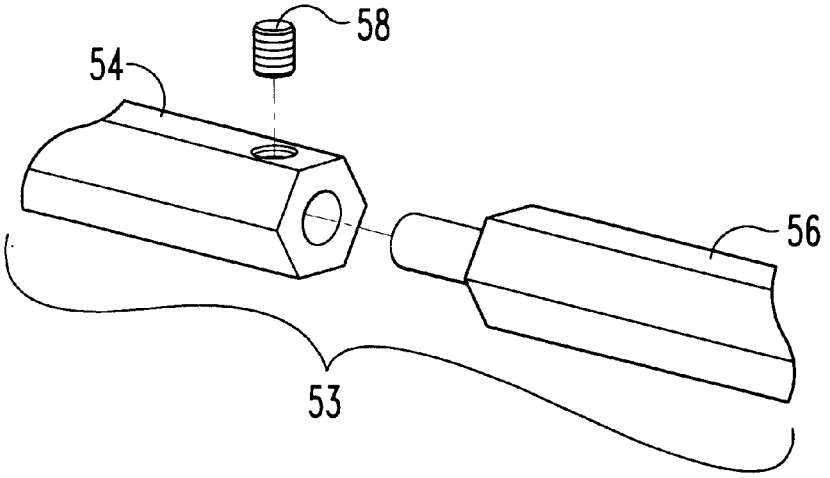
FIG. 3 is an exploded partial view of the mallet axis rod of FIG. 1*a*.

A mallet axis rod or shaft 53 extends horizontally between the two mallet support members 50. Preferably, the mallet axis rod 53 comprises two interlocking portions, a first mallet axis rod portion 54 and a second mallet axis rod portion 56. (See FIG. 3) The mallet axis rod portions 54, 56 interlock to forming a continuous mallet axis rod 53, but may rotate freely with respect to one another. The first mallet axis rod portion 54 is connected to the first mallet support member 51 and the second mallet axis rod portion 56, while the second mallet axis rod portion 56 is connected to the first mallet axis rod portion 54 and the second mallet support member 52. A set screw 58 on the mallet axis rod 53 may be used to lock the mallet axis rod portions 54, 56 such that they may not rotate with respect to one another. (See FIG. 3A) When the set screw 58 is so engaged, depression of either the toe portion 36 or the heel portion 38 actuates both rod portions 54, 56 together. Other contemplated embodiments include a one-piece mallet axis rod having two or more independently rotatable sleeves and a mallet axis rod having more than two independently rotatable segments to which additional mallets may be attached.

A first mallet 70 and a second mallet 72 are connected to the mallet axis rod 53. The first mallet 70 is rigidly coupled to the first mallet axis rod portion 54, while the second mallet 72 is rigidly coupled to the second mallet axis rod portion 56. Each mallet 70, 72 comprises an upper portion 74 and a lower portion 76 coupled at a joint 78. The upper portion 74 is also connected to a striking head 80. The lower portion 76 is rigidly coupled to the axis rod 53 as described above.

The linkage assembly 30 comprises a set of rotatable discs 90, each having peripheries 91, and flexible linkages or connectors 92 connecting the pedal 24 to the mallet axis rod 53 through the peripheries 91 of the discs 90. The set of discs 90 is subdivided into a first set of rotatable discs 94 and a second set of rotatable discs 96, each set 94, 96 having at least one rotatable disc. Likewise, there is a first flexible linkage 98 and a second flexible linkage 100.

A first set of rotatable discs 94 includes a rotatable disc 93 fixedly attached to the first mallet axis rod portion 54, such that upon rotation the first mallet axis rod 54 is fixed regarding the rotatable disc 93. A first flexible connector 98 extends from the toe portion 36 to the peripheries 91 of the first set of rotatable discs 94 (which may include only one disc), connecting the toe portion 36 to the first mallet axis portion 54.

A heel-end disc support member 102 extends upwardly from the base 22. The heel-end disc support member 102 is positioned on the long central axis of the base 22. A base linkage groove 104 extends substantially parallel to the long central axis along the bottom of the base 22 (see FIG. 2). Rotatable discs comprising the second set of rotatable discs 96 are mounted at either end of the heel-end linkage support member 102 (a rotatable disc 95 is mounted to the top end of the heel-end linkage support member 102 and another rotatable disc 97 is mounted at the bottom end of the heel-end linkage support member 102, lying partially within the base linkage groove 104). Another rotatable disc 99, also included in the second set of rotatable discs 96, is mounted at the opposite end of the base 22 and also lies partially within the base linkage groove 104. Yet another rotatable disc 101, also included in the second set of rotatable discs 96, is fixedly attached to the second mallet axis rod portion 56 such that upon rotation, the rotatable disc 101 is fixed with respect to the rotatable second mallet axis rod portion 56. The second flexible linkage 100 extends from the heel portion 38 to the peripheries 91 of the second set of discs 96 through groove 104 and connecting the heel portion 38 to the second mallet axis rod portion 56. The second flexible linkage 100 may include a solid portion, such as a rod, substantially filling groove 104.

A tension member 110 extends from the base 22 or lower portion of the mallet support assembly 26 to either end of the mallet axis rod 53. The tension member 110 of the preferred embodiment is a spring. Each tension member 110 connects to each portion 54, 56 of the mallet axis rod 53 near its respective mallet support member 50.

Figure 1B:
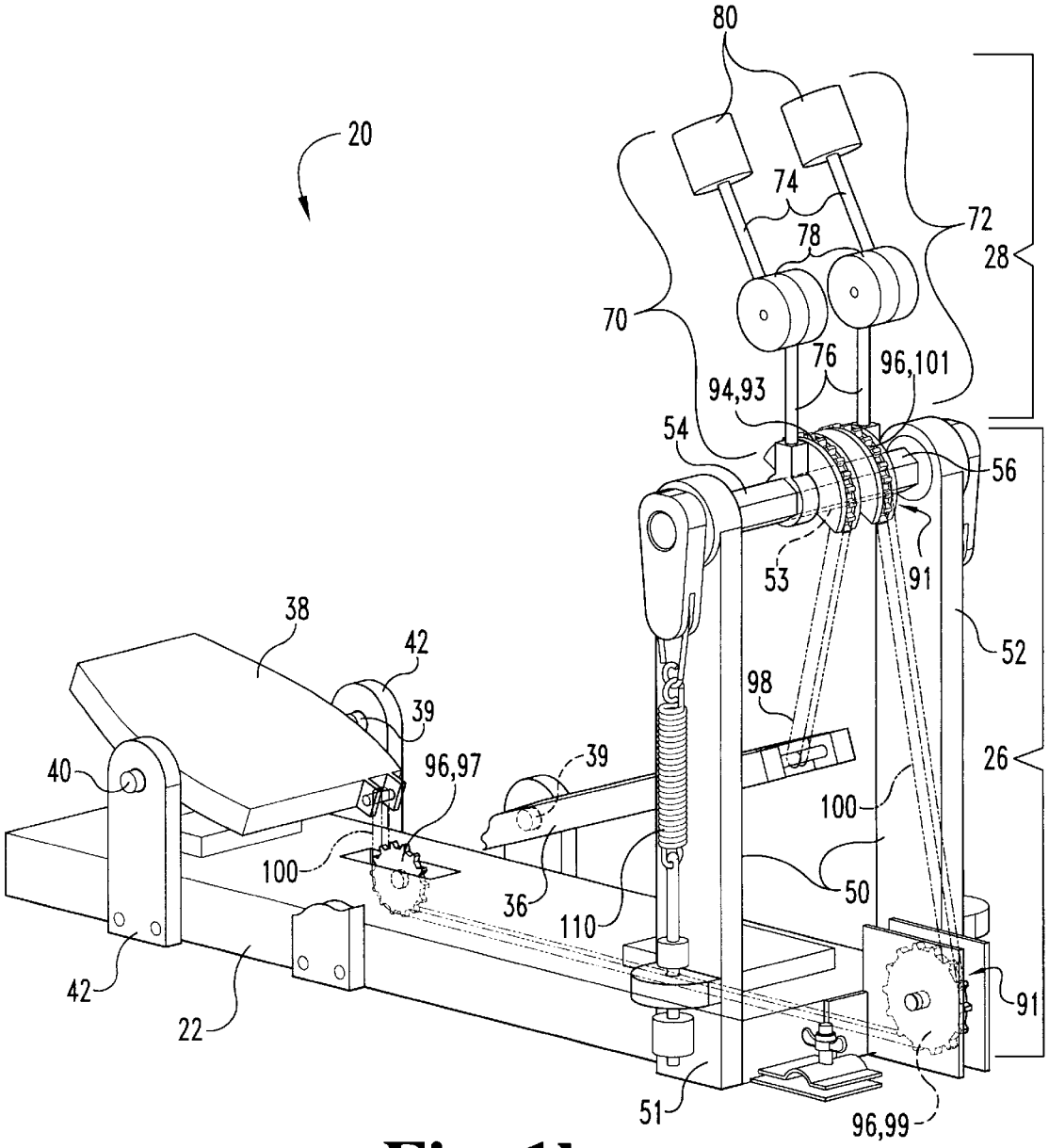
FIG. 1*b* is a perspective view of a second embodiment of the present invention.
Figure 1C:
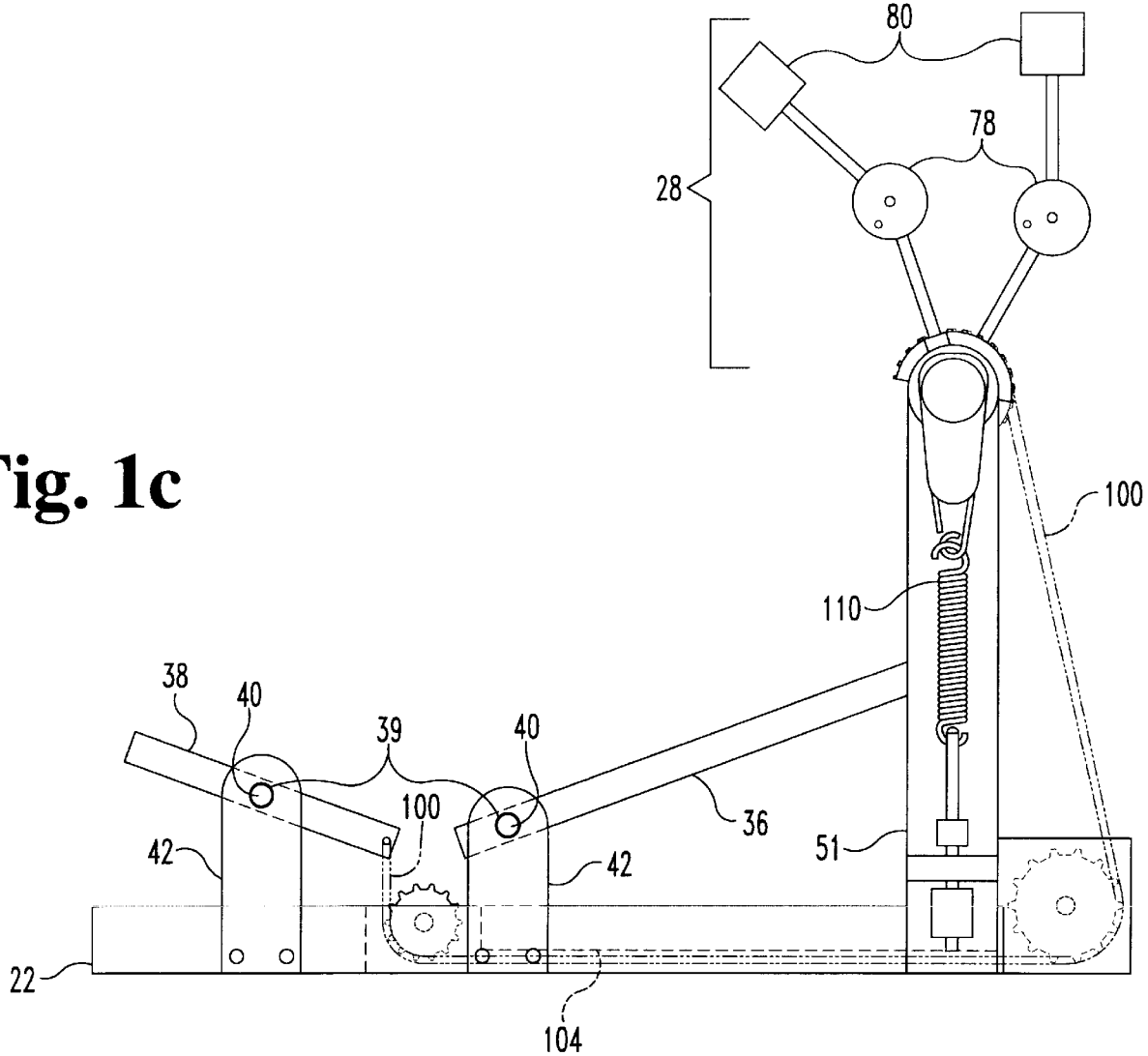
FIG. 1*c* is a side elevation view of the embodiment of FIG. 1*b*.

With reference to FIGS. 1*b* and 1*c*, a second embodiment of the present invention is illustrated. The embodiment of FIGS. 1*b* and 1*c* is identical to the above-described embodiment, with the distinctions that the pedal portions 36, 38 are each coupled to a separate pedal axis rod 40, and the second flexible linkage 100 extends from the pedal heel portion 38 through the base 22 to the peripheries 91 of the second set of rotatable discs 96 through groove 104 and connecting the heel portion 38 to the second mallet axis rod portion 56. In this embodiment, the second flexible linkage may also include a rigid portion, such as a rod, lying in groove 104.

In some contemplated embodiments, the base 22 comprises a flat structural member to which the pedal axis support members 42 and the mallet support assembly 26 are connected. In other contemplated embodiments, the base 22 is envisioned comprising a flat support member with the pedal axis support members 42 and mallet support assembly 26 formed thereto.

Figure 4:
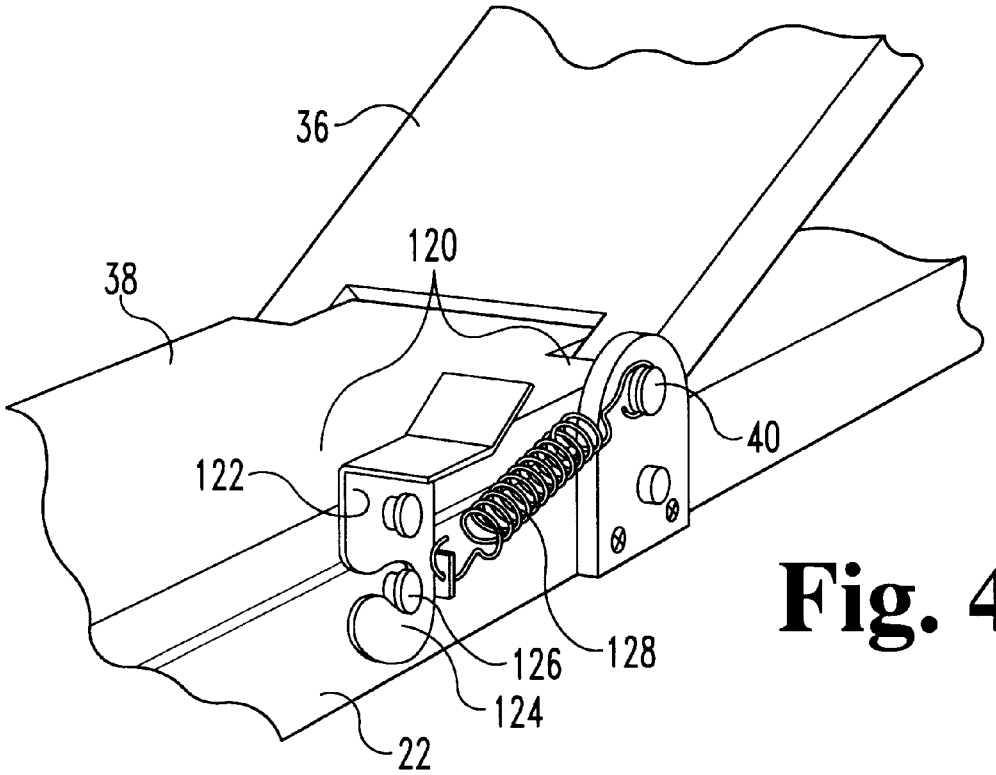
FIG. 4 is an enlarged perspective view of a first locking mechanism for a second embodiment of the present invention.
Figure 5A:
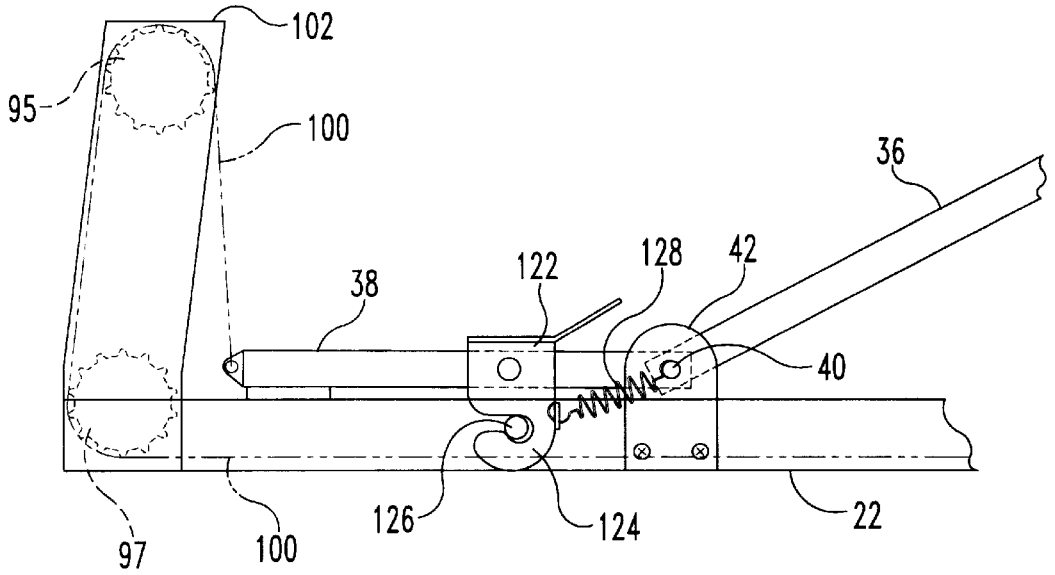
FIG. 5*a* is an illustrative partial side elevation view of the engaged first locking mechanism of FIG. 4.
Figure 5B:
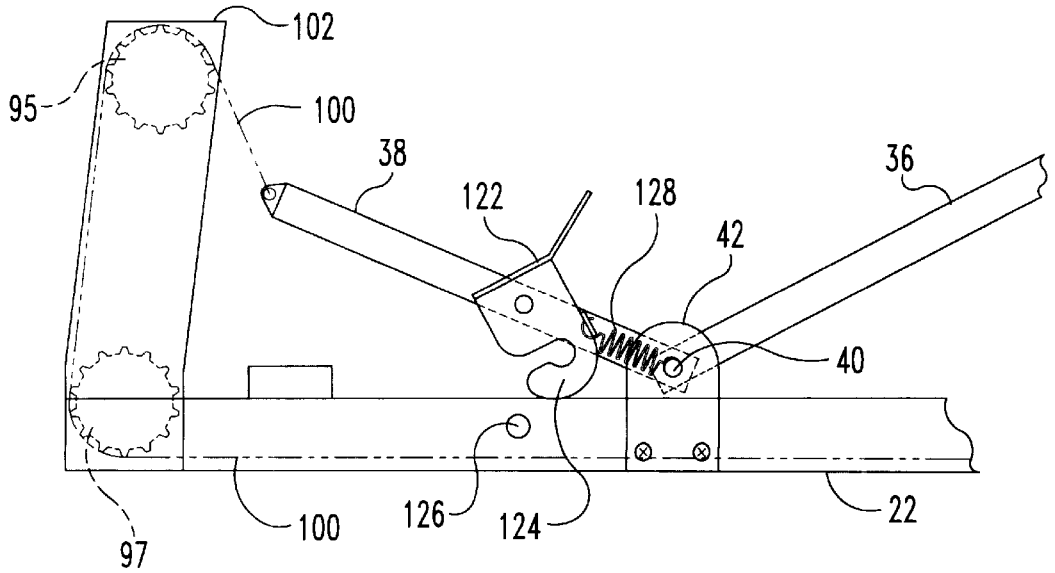
FIG. 5*b* is an illustrative partial side elevation view of the disengaged first locking mechanism of FIG. 4.

Referring to FIGS. 4–5*b*, one form of the present invention includes a locking mechanism 120 adapted to restrict the toe portion 36 or the heel portion 38 from pivoting about the pedal axis rod 40. One contemplated locking mechanism comprises a latch 122 rotatably mounted to the side of one or both portions 36, 38 of the pedal 24. The latch 122 comprises a hook portion 124 adapted to lockingly engage a pin 126 attached to the base 22. A biasing member 128 such as a spring may optionally extend from the hook portion 124 to any convenient point on the base 22 or pedal axis rod support 42 to bias the hook portion 124 away from the pin 126 to prevent accidental engagement thereof.

Figure 6A:
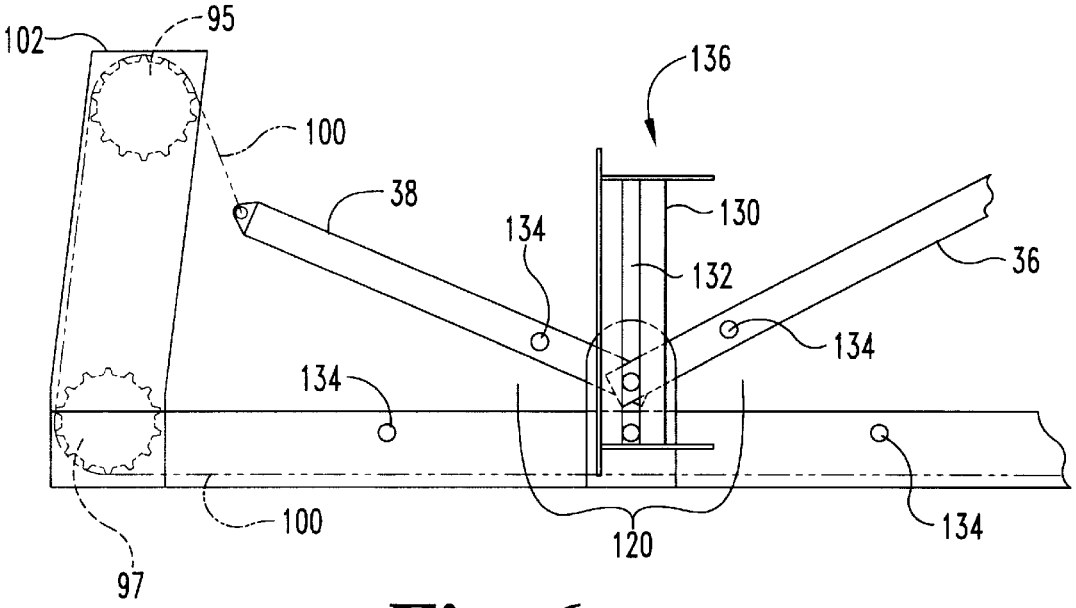
FIG. 6*a* is a partial side elevation view of a second locking mechanism for a third embodiment of the present invention.
Figure 6C:
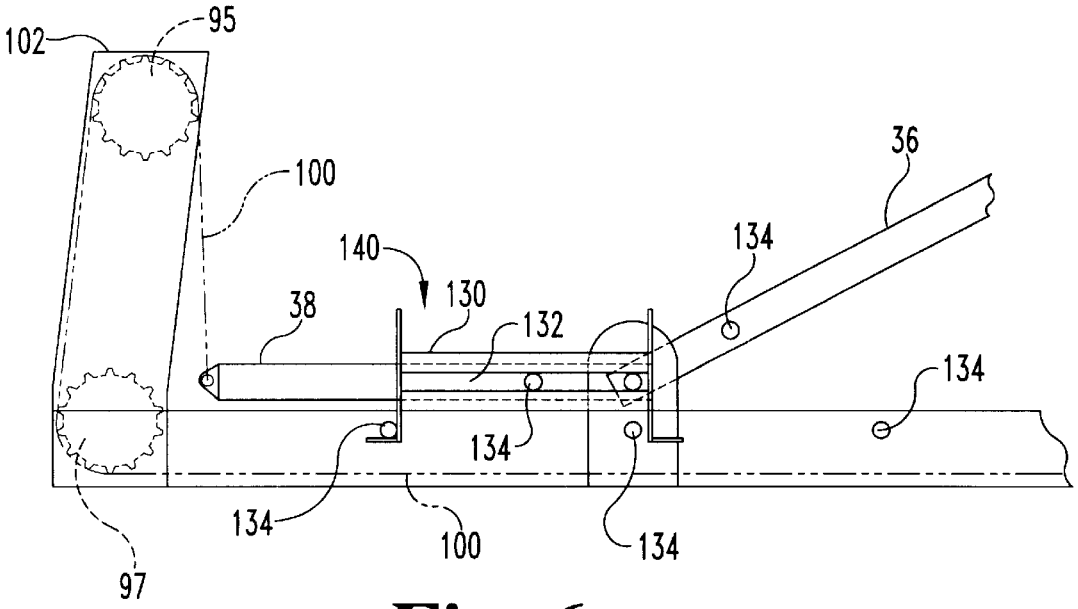
FIG. 6*c* is an illustrative partial side elevation view of the second locking mechanism of FIG. 6*a* in a second locked position.
Figure 6B:
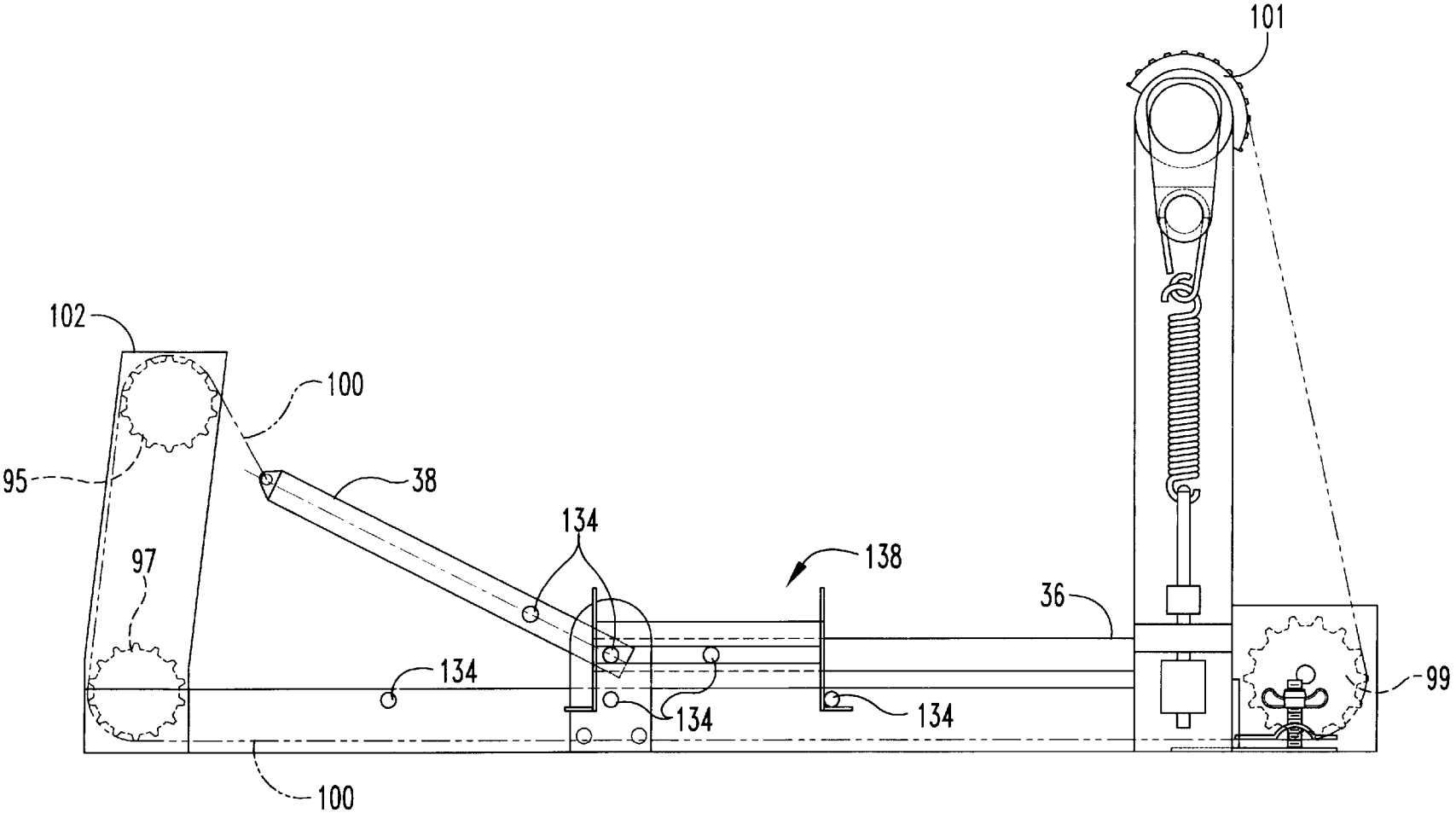
FIG. 6*b* is a partial side elevation view of the second locking mechanism of FIG. 6*a* in a first locked position.

FIGS. 6*a*–*c* illustrate another form of the present invention, having locking mechanism 120. A sliding lock member 130 having a horizontal slot 132 adapted to engage a set of pins 134 mounted on the toe portion 36 and heel portion 38 may be attached to the ped al axis rod support 42. The sliding lock member 130 may be positioned in a neutral central position 136 such that it does not engage the set of pins 134, or may be offset from its neutral position to engage either the toe portion pin engaging position 138 or the heel portion pin engaging position 140, thereby locking the respective portion down.

Figure 7:
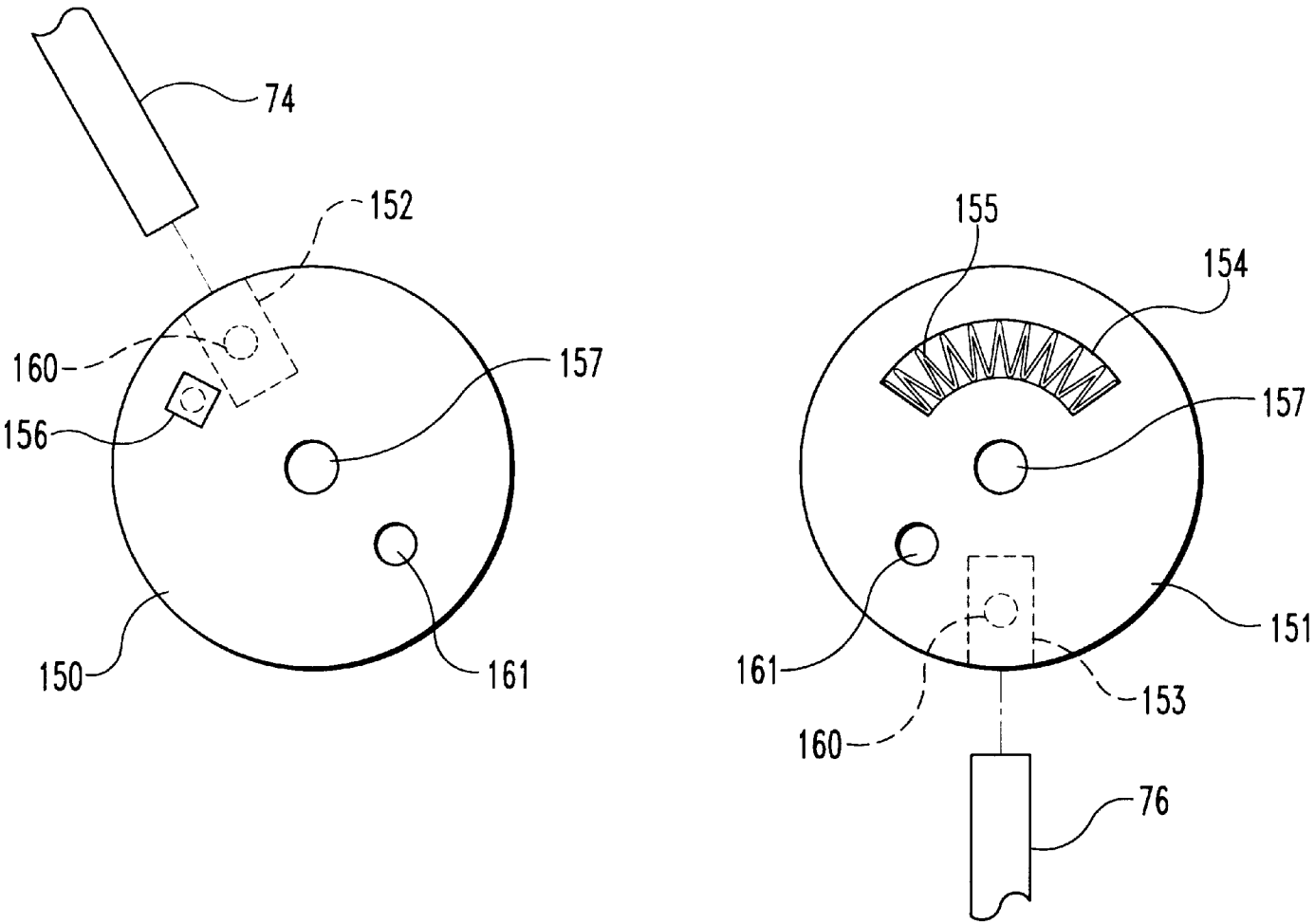
FIG. 7 is a schematic view of the mallet joint of FIG. 1*a*.
Figure 8:
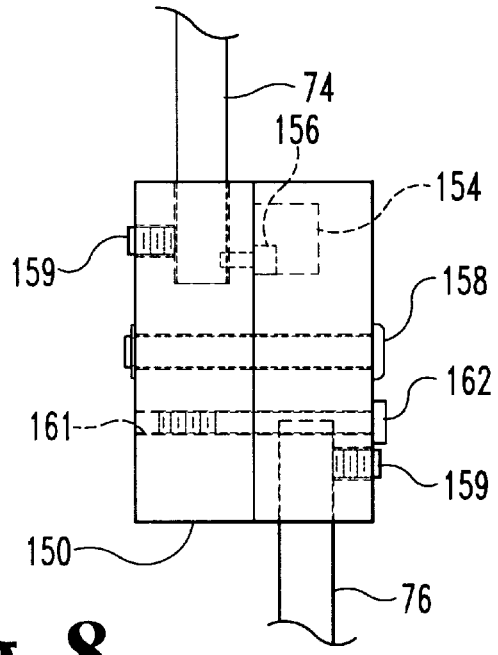
FIG. 8 is a partial front view of the joint of FIG. 7.
Figure 9:
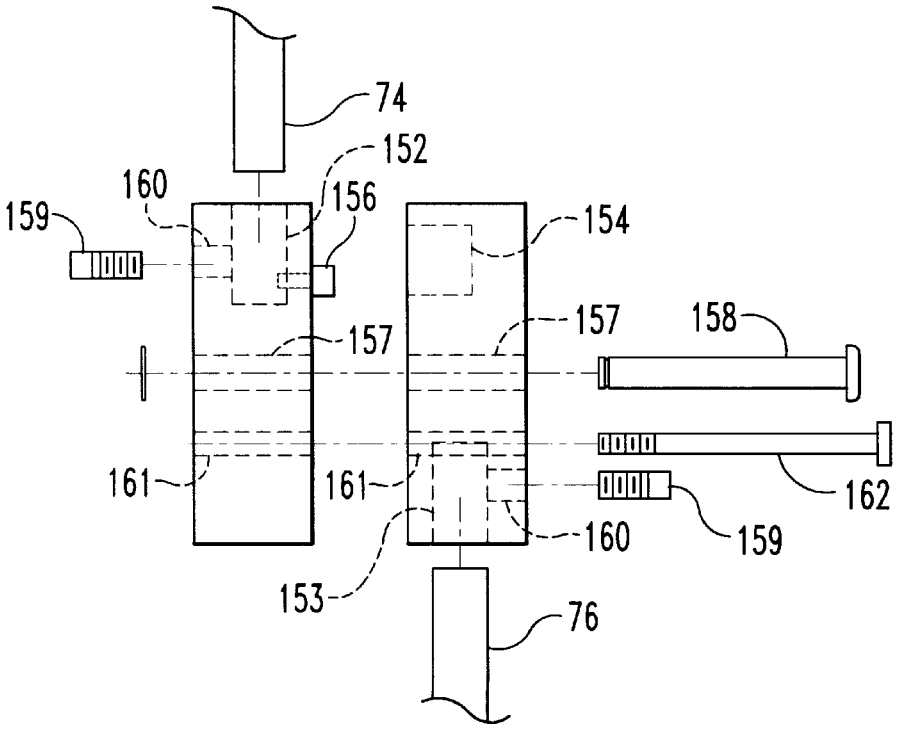
FIG. 9 is an exploded front view of the joint of FIG. 8.

FIGS. 7–9 s how one form of the mallet joint 78 of the present invention. The mallet joint 78 is comprised of two connected discs, an upper mallet-connecting disc 150 and a lower mallet-connecting disc 151. The upper connecting disc 150 and the lower connecting disc 151 each includes a cylindrical cavity 152, 153 adapted to receive the end of an upper mallet portion 74 and a lower mallet portion 76, respectively. The lower connecting disc 151 also includes a curved recess 154 adapted to receive a spring 155. The upper connecting disc 150 includes a protruding pin 156 adapted to extend into the recess 154 and impinge upon the end of the spring 155 when the two discs 150, 151 are connected as the joint 78. The spring 155 biases the upper mallet portion 74 to form an acute angle with the lower mallet portion 76. Each disc 150, 151 also includes a central pin aperture 157, positioned at its center. A central pin 158 extends through the apertures 157 to connect the discs 150, 151. The central pin 158 may be fastened by any convenient means, such as a clip or nut. The upper and lower connecting discs 150, 151 of the assembled joint 78 are free to rotate relative to each other around the central pin 158 unless locked together.

The mallet portions 74, 76 may be fastened in their respective cavities 152, 153 by set screws 159 extending through set screw apertures 160. Alternately, the mallet portions 74, 76 may be fastened to the joint 78 by any conventional means, such as with an anchor or glue.

A disc locking mechanism may also be provided to prevent the upper and lower mallet portions 74, 76 from moving relative to one another. One possible disc locking mechanism is a set screw, although any convenient lock means may be used. It is preferable to position the locking mechanism at the joint 78. It is more preferable to lock the joint 78 such that the mallet portions 74, 76 extend as a straight mallet; e.g. the angle between the lower portion 76 and the upper portion 74 is substantially zero. One such locking mechanism comprises a screw hole 161 extending substantially through the joint 78, through which a screw 162 may be inserted to prevent rotation of the upper connecting disc 150 relative to the lower connecting disc 151, although any conventional locking means may be chosen.

One or more compressible pads 170 may be provided on the base 22 to cushion the impact of the pedal portions 36, 38 during use. The pad or pads 170 are positioned on the base 22 below the pedal portions 36, 38. In addition to providing a mechanical cushion, the pads 170 may also dampen or mute the sound of the pedal portions 36, 38 striking the base 22 when depressed vigorously.

Moreover, it is possible that vigorous depression of a pedal portion 36, 38 may result in not only a mallet head 80 impacting the drum face, but a mallet joint 78 rotating far enough forward to contact the drum face as well. The positioning of a sufficient thickness of pad 170 below the pedal portions 36, 38 addresses this concern by controlledly limiting the depression thereof. Limiting the depression of the pedal portions 36, 38 limits the movement of the linkages 98, 100 and limits the forward rotation of the mallet assembly 28 into the drum face. By controlling the thickness of padding 170 under the pedal portions 36, 38, the forward rotation of the mallet assembly 28 may be constrained such that the mallet heads 80 may be allowed to impact the drum face while the joints 78 are not.

The pads 170 may also provide a slight upward bias to the pedal portion when the optional locking mechanism 120 is engaged, preventing the mechanism from accidentally engaging and disengaging. The pads 170 may be formed of any resilient material, such as foam rubber, plastic, or leather. The pads 170 may be discretely positioned on the base 22 or may continuously cover the base 22. Alternately, the top portion of the base 22 may be formed from a resilient or fibrous material.

In use, depression of the toe portion 36 of the pedal 24 pulls on the first flexible linkage 98. The first linkage 98 is connected to the periphery 91 of the rotatable disc 93 affixed to the first mallet rod portion 54 and exerts a torque thereon. The torque exerted on the first mallet rod portion 54 causes it to rotate forward. Rotation of the first mallet rod portion 54 rotates the first mallet 70 forward. Forward momentum causes the upper mallet portion 74, normally biased away from the drum, to rotate forward into the drum. If the drummer depresses the pedal 24 with sufficient force, the upper mallet portion 74 will snap forward into the drum head. Likewise, depression on the heel portion 38 causes the second flexible linkage portion 100 to pull on the rotatable disc 101 affixed to the second mallet rod portion 56, exerting a forward rotational torque thereon, and rotating the second mallet 72 forward. The pedal portions 36, 38 may be actuated alternately, or they may be actuated in any order, including repeated actuation of just one of the pedals. Either the toe portion 36 or the heel portion 38 may be locked down to provide a rest platform for a portion of the drummer's foot. One or both mallets 70, 72 may also be locked in the upright position to give the drummer additional percussive options. Furthermore, if a pedal portion 36, 38 and its respective mallet 70, 72 are both locked, the mallet 70, 72 will become locked down against the drum head, creating a muffled or mute effect when the other mallet 72, 70 strikes the drum.

The base 22, pedal 24, and support structures 26, 30, 50 may be formed of steel, plastic, or any convenient structural material familiar to one of ordinary skill in the art. The linkages 98, 100 may be formed of any convenient flexible connecting material, such as chain, cord, or cable, and may include rigid portions therein. The mallets 70, 72 may be formed of any structural material readily formable into long, narrow members, such as steel, wood, or plastic. The mallet head 80 may be formed of any resilient and durable material, such as wood, cloth, plastic, or foam rubber, and may have any convenient shape, such as spherical or cylindrical.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A drum pedal assembly for placement adjacent a drum head, comprising:

a base having a pedal axis shaft system and a raised mallet axis shaft;

a pedal having a toe portion and a heel portion, the toe portion depressibly connected to the pedal axis shaft system and the heel portion depressibly connected to the pedal axis shaft system;

a first set of at least one disk rotatably mounted to the base;

a second set of at least one disk rotatably mounted to the base;

a first jointed mallet having a first upper mallet portion rotatably coupled to a first lower mallet portion wherein the first jointed mallet is pivotally coupled to the mallet axis shaft;

a second jointed mallet having a second upper mallet portion rotatably coupled to a second lower mallet portion wherein the second jointed mallet is pivotally coupled to the mallet axis shaft;

a first flexible linkage connected between the toe portion and the first set of rotatably mounted disks, wherein depression of the toe portion around the pedal axis shaft system causes rotation of the first mallet into contact with the drum head; and a second flexible linkage connected between the heel portion and the second set of at least one rotatably mounted disk, wherein depression of the heel portion around the pedal axis shaft causes rotation of the second mallet into contact with the drum head;

wherein the pedal axis shaft system includes at least one pedal axis shaft.

2. The assembly of claim 1 further comprising:

a first pedal axis shaft, wherein the toe portion is depressibly connected to the first pedal axis shaft;

a second pedal axis shaft, wherein the heel portion is depressibly connected to the second pedal axis shaft.

3. The assembly of claim 1 further comprising a first biasing member and a second biasing member extending from the base to the mallet axis shaft.

4. The assembly of claim 2 further comprising a first biasing member extending from the base to the first mallet and a second biasing member extending from the base to the second mallet.

5. The assembly of claim 4 wherein the first and second biasing members are springs.

6. The assembly of claim 1 wherein the mallet axis shaft includes a first mallet axis shaft portion and a second mallet axis shaft portion, and wherein the first portion and the second portion are adapted to rotate independently of each other.

7. The assembly of claim 6 wherein the first mallet is connected to the first mallet axis shaft portion and the second mallet is connected to the second mallet axis shaft portion.

8. The assembly of claim 1 further comprising a locking lever connected to the base, wherein the lever is adapted to prevent a portion of the pedal from moving.

9. The assembly of claim 1 further comprising:

a first biasing spring extending from the base to the first mallet axis shaft;

a second biasing spring extending from the base to the second mallet axis shaft; and a locking lever connected to the base, wherein the lever is adapted to prevent a portion of the pedal from moving;

wherein the mallet axis shaft includes a first mallet axis shaft portion and a second mallet axis shaft portion adapted to rotate independently of each other;

wherein the first mallet is connected to the first mallet axis shaft portion and the second mallet is connected to the second mallet axis shaft portion.

10. A dual drum pedal assembly comprising:

a base;

a pedal axis shaft mounted to the base;

a pedal having a toe portion and a heel portion independently rotatably coupled to a pedal axis shaft;

a first axis support member mounted to the base;

a second axis support member mounted to the base;

an axis rod having a first rod portion and a second rod portion extending from the first axis support member to the second axis support member;

a first articulated beater pivotally mounted to the first rod portion;

a second articulated beater pivotally mounted to the second rod portion;

a first flexible connector extending from the toe portion to the first rod portion;

a second flexible connector extending from the heel portion to the second rod portion;

a first spring extending from the axis rod to the first axis support member; and a second spring extending from the axis rod to the second axis support member;

wherein the first rod portion is rotatable independently of the second rod portion.

11. A drum pedal assembly for placement adjacent a drum head, comprising:

a base;

a pedal toe portion and a pedal heel portion independently depressibly coupled to the base;

a mallet assembly mounted to the base including:

a mallet support member mounted to the base;

a mallet axis rod extending from the mallet support member;

a first jointed mallet pivotably coupled to the mallet axis rod;

a second jointed mallet pivotably coupled to the mallet axis rod; and a linkage assembly adapted to operationally connect the toe portion to the first mallet and the heel portion to the second mallet;

wherein depression of the toe portion actuates pivoting of the first mallet;

wherein depression of the heel portion actuates pivoting of the second mallet; and wherein the first mallet is adapted to pivot independently of the second mallet.

12. The drum pedal assembly of claim 11 wherein the linkage assembly further comprises:

a second set of disks including a second disk rotatably connected to the base and a second disk connected to the mallet axis rod, the second disk connected to the mallet axis rod being oriented at a fixed position relative to the second mallet;

a second flexible connector extending from the heel portion to the second set of disks;

a first disk connected to the mallet axis rod, the first disk connected to the mallet axis rod being oriented at a fixed position relative to the first mallet; and a first flexible connector extending from the toe portion to the first disk.

13. The assembly of claim 11 further comprising a tension means operationally connected to the mallet axis rod and the base for returning a pivoted mallet to a substantially vertical position relative to the base.

14. The assembly of claim 13 wherein the tension means is a spring.

15. The assembly of claim 11 further comprising a tension means coupled to the base and the pedal for returning the pedal to an elevated disposition.

16. The assembly of claim 11 wherein the first mallet includes a first mallet upper portion rotatably coupled to a first mallet lower portion.

17. The assembly of claim 16 wherein the second mallet further includes a second mallet upper portion rotatably coupled to a second mallet lower portion.

18. The assembly of claim 16 further comprising a first spring-biased connecting disk coupling the first mallet upper portion to the first mallet lower portion and a second spring-biased connecting disk coupling the second mallet upper portion to the second mallet lower portion.

19. The assembly of claim 11 further comprising a first pedal axis rod support extending from the base, a first pedal axis rod connected to the first pedal axis rod support and suspended therefrom above the base, a second pedal axis rod support extending from the base, and a second pedal axis rod connected to the second pedal axis rod support and suspended therefrom above the base, wherein the pedal toe portion is coupled to the first pedal axis rod and wherein the pedal heel portion is coupled to the second pedal axis rod.

20. The drum pedal assembly of claim 10 further comprising a lock operationally connected to the pedal and adapted to selectively prevent a portion of the pedal from moving.

21. The drum pedal assembly of claim 11 further comprising a lock coupled to the pedal and adapted to prevent a portion of the pedal from moving.

* * * * *